United States Patent [19]

Rice

[11] Patent Number: 4,530,503

[45] Date of Patent: Jul. 23, 1985

[54] LOTTERY SELECTORS

[75] Inventor: Richard R. Rice, Hamilton, Canada

[73] Assignee: Larry Richard Rice, Hamilton, Canada

[21] Appl. No.: 474,809

[22] Filed: Mar. 14, 1983

[51] Int. Cl.[3] ..... A63F 7/04; A63F 3/06; G07C 15/00

[52] U.S. Cl. ..... 273/144 B; 401/195

[58] Field of Search ..... 273/144, 145; 248/523; 401/195

[56] References Cited

U.S. PATENT DOCUMENTS

| | | | |
|---|---|---|---|
| 646,364 | 3/1900 | Donnelly | 248/523 |
| 2,786,641 | 3/1957 | Applegate | 248/523 |
| 2,799,506 | 7/1957 | Nord | 273/144 B |
| 2,896,576 | 7/1959 | Baer | 401/195 |
| 2,985,453 | 5/1961 | Matisz | 273/145 C |
| 3,429,644 | 2/1969 | Mueller | 401/195 |
| 4,124,207 | 11/1978 | Breslow et al. | 273/144 B X |

FOREIGN PATENT DOCUMENTS

| | | | |
|---|---|---|---|
| 2630020 | 1/1978 | Fed. Rep. of Germany | 273/144 B |
| 2382059 | 10/1978 | France | 273/144 B |
| 2400738 | 4/1979 | France | 273/144 B |
| 1503337 | 3/1978 | United Kingdom | 401/195 |

*Primary Examiner*—Paul E. Shapiro

[57] ABSTRACT

The present invention provides a selector arrangement for selection of lottery numbers and the like. The selector arrangement comprises a stand having a hollow, upright portion and a selector member detachable from the stand. The selector member itself comprises a mixing region for intermixing a plurality of indicia-bearing members and a selector region into which the indicia-bearing members are freely and randomly moveable for ordered stacking. The selector region is transparent for viewing of the ordered stacking to provide the selection and includes a first end which is opened to the mixing region for gravity feeding of the indicia bearing members to the selector region and a second closed end remote from the mixing region with a sleeve provided at the second end for sleeving over the hollow upright portion of the stand in a first support mode and for sleeving onto one end of a writing tool, the other end of which is located within the hollow upright portion of the stand in a second support mode for the selector member.

3 Claims, 3 Drawing Figures

LOTTERY SELECTORS

FIELD OF THE INVENTION

The present invention relates to a selector for the random selection of lottery numbers and the like.

BACKGROUND OF THE INVENTION

As many people who play lotteries will appreciate it is often difficult to make up one's mind as to what might possibly be a winning lottery selection. Accordingly there is a need for a selector which will automatically perform this function for the lottery participant. Furthermore the device must be one which is easily operated to make a random lottery selection.

SUMMARY OF THE PRESENT INVENTION

The present invention provides a selector for selection of lottery numbers and the like. The selector comprises a mixing region for intermixing a plurality of indicia bearing members within the selector, a selector region into which the indicia bearing members are freely and randomly moveable from the mixing region and which is adapted for ordered stacking of the indicia bearing members. The selector region is transparent for viewing of such ordered stacking to provide the selection and has a first end which is open to the mixing region for gravity feeding the indicia bearing members to the selector region. The selector region also has a second closed end remote from the mixing region with sleeve means being provided at this second end for receiving a support for the selector. The support may be in the form of a stand to hold the selector in an upward position or the support may for example be a writing tool or the like which also acts has a handle for manually moving the selector for the intermixing of the indicia bearing members within the mixing region.

BRIEF SUMMARY OF THE INVENTION

The above as well as other advantages and features of the present invention will be described in greater detail according to the preferred embodiments of the present invention in which.

DETAILED DESCRIPTION ACCORDING TO THE PREFERRED EMBODIMENTS

Figure 1:
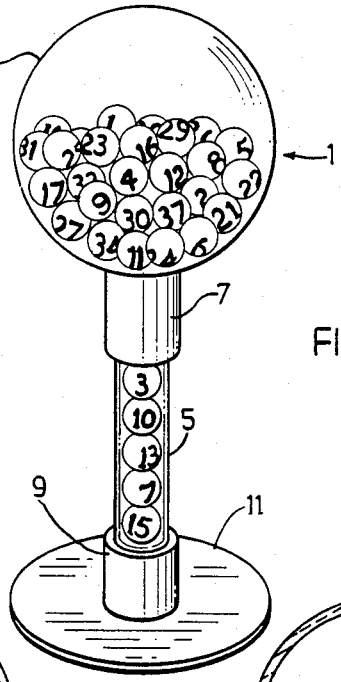
FIG. 1 is a side view of a lottery selector member according to a preferred embodiment of the present invention.

Referring first to FIG. 1, the lottery selector member generally indicated at 1 contains a plurality of numbered balls which are moveable between an upper mixing region 3 and a lower selector region 5 which are secured with respect to one another by means of a throat portion 7. The mixing region is of a size such that it will accommodate all of the numbered balls and allow full intermixing of the balls in the mixing region. The selector region on the other hand is dimensioned to provide an ordered stacking of the balls which in this particular arrangement are stacked individually within the selector region. The selector region is transparent to view such ordered stacking to arrive at a random lottery selection.

The selector arrangement which forms a stem branching off from the mixing region is open at its upper end to the mixing region and is closed at its lower end to prevent the balls from falling out of the selector. Provided at the lower end of the stem-like selector region is a sleeve member 9 which in FIG. 1 is fitted over an upright portion of a stand 11 for supporting the selector in an upright position. This same stand 11 is also shown in FIGS. 2 and 3 with the upright portion of the stand being indicated at 13.

Figure 2:
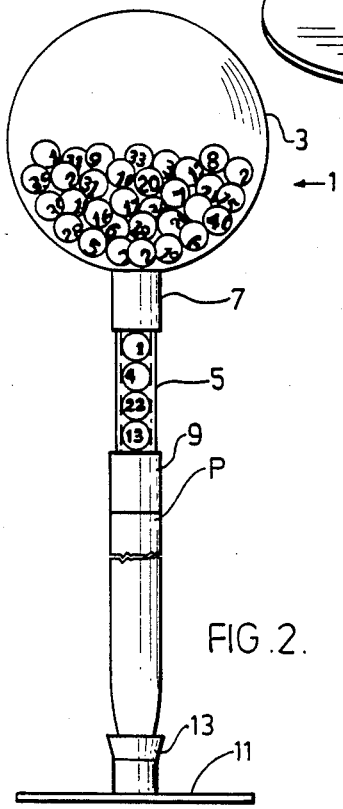
FIG. 2 is a side view of a lottery selector member when fitted to a pen for supporting the selector member.

In FIG. 2 the selector member 1 is secured to the end of a pen P. As shown in FIG. 3, this securing is accomplished by a threaded connection between sleeve 9 and the upper end of the pen. This allows the selector member to be removed from the pen to replace parts such as the ink cartridge within the pen.

Figure 3:
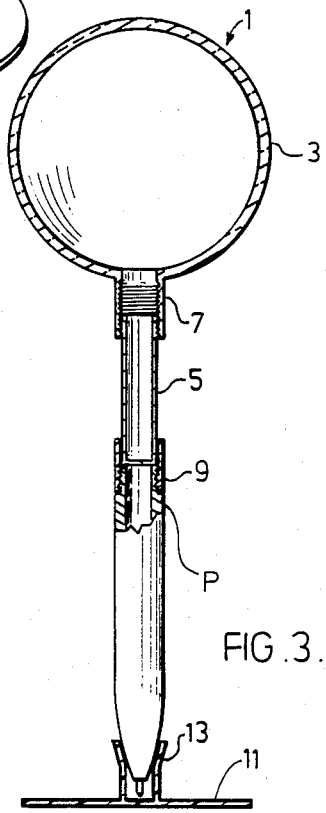
FIG. 3, shows in section, the assembly of FIG. 2.

With the arrangement of FIGS. 2 and 3 the pen is used as a handle for manually moving the selector member in a shaking motion for a thorough intermixing of the balls while they are in the mixing region. The pen is then simply fitted within the hollowed upright portion 13 of stand 11 such that the pen stands up in the FIG. 2 position. In this standing position the balls fall down into the selector region and the numbers are read off of these balls to provide a lottery number selection.

It should be noted that in FIG. 1 only four balls can be seen in the selector region whereas in FIG. 2, five balls are shown within the selector region. This is due to the fact that the stem portion is adjustable within the throat portion 7 to adjust the overall length of the selector region and the number of balls that will fit therein in any one time. According to a preferred embodiment of the present invention, as shown in FIG. 3, the upper end of the stem portion 5 and the interior of the throat 7 are both threaded to allow a threaded adjustment of the length of the stem portion. This permits the lottery selector to be used with different types of lotteries having different numbers in each selection.

As an added feature of the present invention stem portion 5 is completely removable from throat 7 which provides an interior access to the selector. This enables the replacement of these particular numbered balls with other numbered balls or other types of indicia bearing members which might be found in various different types of lotteries.

As will be appreciated the arrangements described above are not only functional but additionally provide economical structures which are fun to use for participants of different lotteries. Furthermore, although various preferred embodiments of the present invention have been described herein in detail it will be appreciated by those skilled in the arts that variations may be made thereto without departing from the spirit of the invention or the scope of the appended claims.

The embodiments of the invention in which an exclusive property or privilege is claimed are defined as follows:

1. A selector arrangement for selection of lottery numbers, and the like, said selector arrangement comprising a stand having a hollow upright portion and a selector member detachable from said stand, said selector member comprising a mixing region for intermixing a plurality of indicia bearing members within said selector member and a selector region into which the indicia bearing members are freely and randomly moveable from said mixing region and which is sized for ordered stacking of the indicia bearing members in the selector region; said selector region being transparent for viewing of such ordered stacking to provide the selection and having a first end which is opened to said mixing region for gravity feeding the indicia bearing members to said selector region and a second closed end remote from said mixing region and sleeve means at said second end of said selector region for sleeving over said hollow upright portion of said stand in a first support mode for said selector member and for sleeving onto one end of a writing tool the other end of which is located within said hollow upright portion of said stand in a second support mode for said selector member.

2. A selector as claimed in claim 1 wherein said selector region comprises a stem portion for individual stacking of the indicia bearing members therein, said stem portion being adjustable in length for receiving different numbers of indicia bearing members for different types of lotteries.

3. A selector as claimed in claim 2 including a throat portion for interconnecting said mixing region and said stem portion which is adjustably and removeably secured in said throat portion.

* * * * *